United States Patent [19]

le Comte

[11] 4,241,645

[45] Dec. 30, 1980

[54] VENTILATOR

[76] Inventor: Adolf le Comte, Stuartweg 4, 4131 NJ Vianen, Netherlands

[21] Appl. No.: 62,756

[22] Filed: Aug. 1, 1979

[30] Foreign Application Priority Data

Aug. 10, 1978 [NL] Netherlands ..... 7808368

[51] Int. Cl.[3] ..... B63J 2/00

[52] U.S. Cl. ..... 98/37; 98/32; 114/211; 137/433

[58] Field of Search ..... 98/32, 37, 2.14, 76; 114/211, 212; 137/430, 433

[56] References Cited

U.S. PATENT DOCUMENTS

| | | | |
|---|---|---|---|
| 1,790,059 | 1/1931 | Nelson | 114/211 |
| 2,775,979 | 1/1957 | Stout et al. | 137/433 |
| 2,935,081 | 5/1960 | Kryzer | 137/433 |
| 3,311,043 | 3/1967 | Atkinson | 98/37 |
| 3,741,100 | 6/1973 | Beck | 114/211 |
| 3,869,967 | 3/1975 | Lenz | 114/211 |
| 3,919,927 | 11/1975 | Bernard, Jr. | 98/37 |

FOREIGN PATENT DOCUMENTS

| | | | |
|---|---|---|---|
| 1346 | of 1896 | United Kingdom | 114/212 |

*Primary Examiner*—Henry C. Yuen

*Attorney, Agent, or Firm*—Weingarten, Maxham & Schurgin

[57] ABSTRACT

A ventilator, in particular for an air shaft of a space to be ventilated on board a vessel, said ventilator comprising a box-shaped housing that is at least partly open downwards, and a hood-shaped part continuous with said housing and in open communication therewith, which hood-shaped part is open outwards on one side. In order to substantially decrease, or fully prevent the ingress of water in the air shaft through the ventilator, there are provided in the housing at least one horizontal longitudinal partition and at least two transverse partitions continuous therewith and extending in substantially vertical and opposite directions, said partitions dividing the housing in two parts, said longitudinal partition having an opening therein that can be closed by means of a float.

4 Claims, 1 Drawing Figure

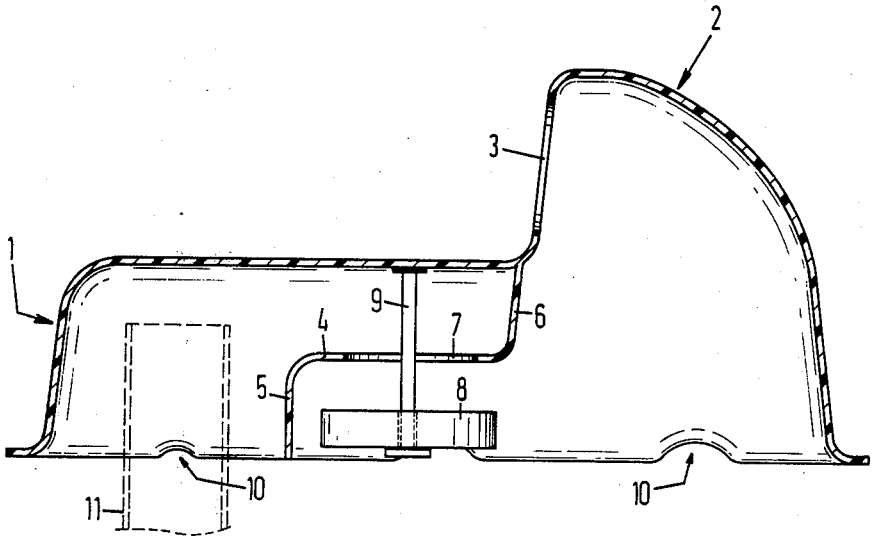
2
3
1
9
4
7
6
5
8
10
11
10

VENTILATOR

This invention relates to a ventilator, in particular for an air shaft of a space to be ventilated on board a vessel, said ventilator comprising a box-shaped housing that is at least partly open downwards, and an adjacent hood-shaped part continuous with said housing and in open communication therewith, which hood-shaped part is open outwards on one side.

It is an object of the present invention to improve such a ventilator, which is well-known in the art, in such a manner that the chance of the ingress of, for example, water that is shipped by the ventilator, is considerably reduced or fully prevented.

For this purpose, the ventilator according to the invention is characterized in that there are provided in the housing at least one horizontal longitudinal partition and at least two transverse partitions continuous therewith and extending in substantially vertical and opposite directions, said partitions internally dividing the housing in two adjacently disposed parts, said longitudinal partition having an opening therein that can be closed by means of a float.

In a further elaboration of the invention, the free edge of the downwardly open housing is provided with recesses for the drainage of any water that finds its way into the ventilator.

It is noted that ventilators comprising a downwardly open housing and equipped with a float are known per se for the venting of ship's tanks. In these prior devices, however, no adequate measures have been taken to prevent the ingress of water into the air shaft.

One embodiment of the invention will now be described, by way of example, with reference to the accompanying drawing, which illustrates a longitudinal section of a ventilator according to the invention.

Referring to the drawing, a ventilator comprises a box-shaped housing 1 that is fully open downwardly. Continuous, and in open communication with housing 1 is a hood-shaped part 2, which is equipped with an air inlet opening 3.

Housing 1 is internally divided into two adjacent compartments by means of a longitudinal partition 4 and two transverse partitions 5 and 6, continuous therewith. Provided in longitudinal partition 4 is an opening 7 that can be closed by means of a float 8, which can slide along a pin 9 secured to housing 1.

The free, curved lower edge of the housing, through which the device can be secured, for example to a vessel's deck, is formed with recesses 10.

The operation of the device is as follows: In use the outside air is in free communication through opening 3, hood-shaped part 2, housing 1 and opening 7 with the mouth of an air shaft 11, shown in dash lines, of a space to be ventilated. In the event that water penetrates the device through opening 3, float 8 will close opening 7, owing to which the water cannot enter that compartment of housing 1 in which air shaft 11 terminates (the left-hand compartment as viewed in the drawing). In order to prevent any water that may find its way into the compartment after all from flowing into the air shaft 11, shaft 11 is arranged so that its mouth is in the top of the compartment. Any water that flows into the device will drain out of it through recesses 10. It is noted in this connection that the recesses 10 in the compartment housing air shaft 11 are smaller than the recesses 10 formed in the remaining part. It is thus ensured that no water can penetrate into air shaft 11 through these recesses either.

It is clear that many modifications can be made without departing from the scope of the present invention.

I claim:

1. A ventilator for use with an air shaft on board a vessel, said ventilator comprising:

a housing comprised of a box-shaped part and an adjacently disposed hood-shaped part which is outwardly open on one side;

a plurality of transverse partitions extending in substantially opposite directions within said housing, at least one said transverse partition being internally attached to and continuous with said housing;

at least one longitudinal partition having an air inlet opening within said housing, said longitudinal partition being joined to and continuous with said transverse partition internally attached to said housing and to at least one other transverse partition, said transverse and longitudinal partitions internally dividing said housing into two adjacent compartments; and floating means to close the air inlet opening in said longitudinal partition.

2. The ventilator as recited in claim 1 wherein the box-shaped part and the hood-shaped part of said housing are partially open downwardly and have downwardly facing edges formed with at least one recess which permits water to flow outwardly from within said housing.

3. The ventilator as recited in claim 2 wherein the downwardly facing edges of the box-shaped part and the downwardly facing edges of the hood-shaped part of said housing are formed with at least one recess in each part.

4. The ventilator as recited in claim 3 wherein said recess within the downwardly facing edges of the box-shaped part is smaller than said recess within the downwardly facing edges of the hood-shaped part of said housing.

* * * * *